United States Patent [19]

Yokoe et al.

[11] Patent Number: 4,964,352

[45] Date of Patent: Oct. 23, 1990

[54] EMBROIDERY DATA PROCESSING SYSTEM FOR AUTOMATIC SEWING MACHINE

[75] Inventors: Masaaki Yokoe, Nagoya; Yoshikazu Kurono, Aichi; Koji Hayashi; Tomoe Takagi, both of Nagova; Narihiro Matsushita, Kasugai; Yuzo Takagi, Nagoya, all of Japan

[73] Assignee: Brother Kogyo Kabushiki Kaisha, Aichi, Japan

[21] Appl. No.: 432,455

[22] Filed: Nov. 6, 1989

[30] Foreign Application Priority Data

Nov. 11, 1988 [JP] Japan ..... 63-286219
Nov. 18, 1988 [JP] Japan ..... 63-293253

[51] Int. Cl.[5] ..... D05C 5/04; D05C 9/04

[52] U.S. Cl. ..... 112/103; 112/121.12; 112/457

[58] Field of Search ..... 112/103, 102, 121.12, 112/121.11, 457, 456, 262.3, 266.1

[56] References Cited

U.S. PATENT DOCUMENTS 4,220,101 9/1980 Nanai et al. ..... 112/456
4,352,334 10/1982 Childs et al. ..... 112/103 X
4,388,883 6/1983 Hirota et al. ..... 112/121.12
4,520,745 6/1985 Shinomiya et al. ..... 112/121.12 X
4,691,649 9/1987 Takano et al. ..... 112/121.12
4,704,977 11/1987 Nukushina ..... 112/456 X
4,823,714 4/1989 Yokoe et al. ..... 112/103 X
4,825,784 5/1989 Nomoto ..... 112/103

FOREIGN PATENT DOCUMENTS 60-42740 9/1985 Japan .
63-125284 5/1988 Japan .

*Primary Examiner*—Peter Nerbun
*Attorney, Agent, or Firm*—Oliff & Berridge

[57] ABSTRACT

An embroidery data processing system controls an automatic sewing machine to produce an embroidery design having a blurred side or blurred boundary line between adjacent blocks which make up the embroidery design. The embroidery data processing system includes a first memory storage area for storing side information indicating sides of each of the blocks, a second memory storage area for storing thread density information indicating the thread density of stitches to be formed in said each block, a third memory stoage area for storing in/out patterns indicating how stitching points are to be displaced with respect to the sides of a selected one of the blocks, which are indicated by the side information, and a controller for calculating stitching points depending on the thread density information along the sides of the selected block according to the in/out patterns, and for calculating stitching points depending on the thread density information along the sides of another block than the selected block, which are indicated by the side information. The third memory storage area may store in/out patterns indicating how stitching points are to be displaced with respect to the sides of said each block which are indicated by the side information, and the controller may calculate stitching points depending on the thread density information along the side of said each block according to the in/out patterns.

18 Claims, 11 Drawing Sheets

FIG. 3

| | | 1ST BLOCK | 2ND BLOCK | ------ |
|---|---|---|---|---|
| 8a SIDE INFORMATION STORAGE AREA | SD1 | SD11 | SD12 | ------- |
| | SD2 | SD21 | SD22 | ------- |
| | SD3 | SD31 | SD32 | ------- |
| | SD4 | SD41 | SD42 | ------- |
| 8b THREAD DENSITY INFORMATION STORAGE AREA | d | d1 | d2 | -------- |
| 8c IN/OUT PATTERN STORAGE AREA | I1 | I11 | I12 | -------- |
| | I2 | I21 | I22 | -------- |

FIG. 4

| | | Br1 | Br2 | Br3 |
|---|---|---|---|---|
| | SD1 | A | E | F |
| | SD2 | B | E | G |
| 8a | SD3 | C | F | H |
| | SD4 | D | G | I |
| 8b | d | d1 | d2 | d3 |
| 8c | I1 | 4 | | |
| | I2 | 0.7 | | |

FIG. 7

| | | | 1ST BLOCK | 2ND BLOCK | ----- |
|---|---|---|---|---|---|
| 8a | SIDE INFORMATION STORAGE AREA | A | A1 (XA1, YA1) | A2 (XA2, YA2) | ----- |
| | | B | B1 (XB1, YB1) | B2 (XB2, YB2) | ----- |
| | | C | C1 (XC1, YC1) | C2 (XC2, YC2) | ----- |
| | | D | D1 (XD1, YD1) | D2 (XD2, YD2) | ----- |
| 8b | THREAD DENSITY INFORMATION STORAGE AREA | d | d1 | d2 | ----- |
| 8c | IN/OUT PATTERN STORAGE AREA | I1 | I11 | I12 | ----- |
| | | I2 | I21 | I22 | ----- |
| | | I3 | I31 | I32 | ----- |
| | | I4 | I41 | I42 | ----- |
| | | I5 | I51 | I52 | ----- |
| | | I6 | I61 | I62 | ---- |

FIG. 10B
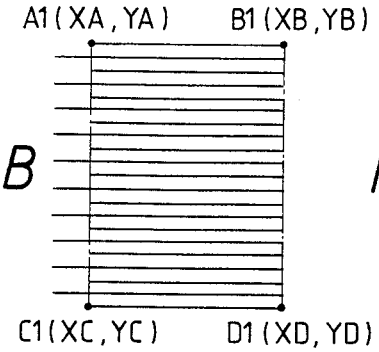
FIG. 10A
| | |
|---|---|
| I11 | L |
| I21 | Ou |
| I31 | 20 |
| I41 | 1 |
| I51 | 1 |
| I61 | N |
FIG. 11B
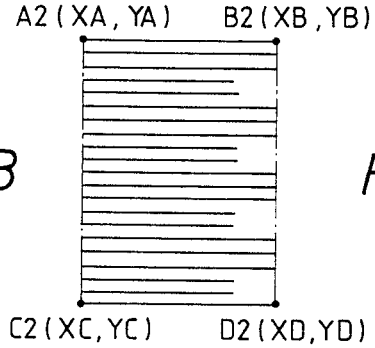
FIG. 11A
| | |
|---|---|
| I12 | R |
| I22 | In |
| I32 | 20 |
| I42 | 3 |
| I52 | 2 |
| I62 | N |
FIG. 12B
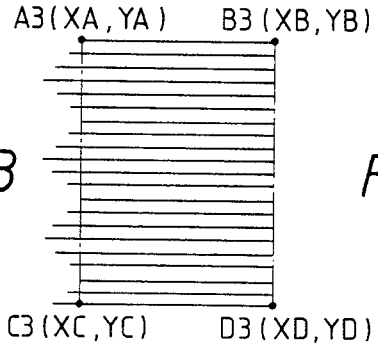
FIG. 12A
| | |
|---|---|
| I13 | L |
| I23 | Ou |
| I33 | 20 |
| I43 | 1 |
| I53 | 5 |
| I63 | W1 |
FIG. 13B
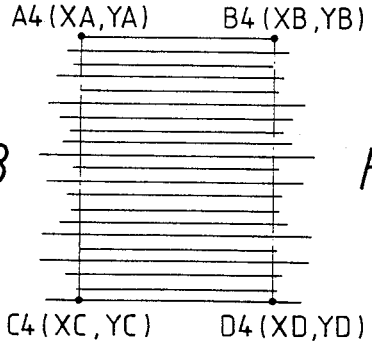
FIG. 13A
| | |
|---|---|
| I14 | LR |
| I24 | Ou |
| I34 | 20 |
| I44 | 1 |
| I54 | 999 |
| I64 | Ra |

FIG. 14
| | | | |
|---|---|---|---|
| A | A1 | B1 | B2 |
| B | B1 | B2 | B3 |
| C | C1 | D1 | D2 |
| D | D1 | D2 | D3 |
| d | d1 | d1 | d1 |
| I 1 | R | LR | L |
| I 2 | In | Ou | Ou |
| I 3 | 20 | 20 | 20 |
| I 4 | 3 | 1 | 1 |
| I 5 | 2 | 999 | 1 |
| I 6 | N | Ra | N |
FIG. 15
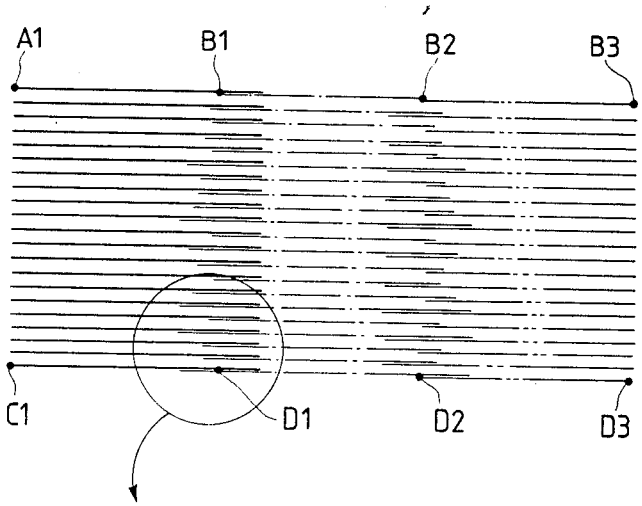
FIG. 16
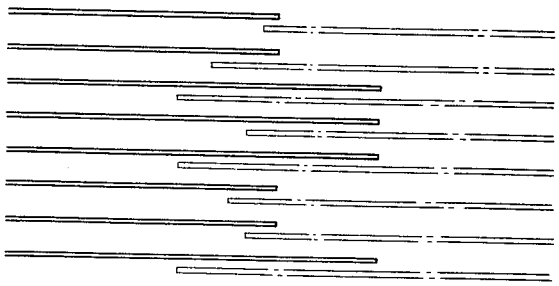

| | |
|---|---|
| SD1 | P |
| SD2 | Q |
| SD4 | R |
| SD5 | S |
| d | d10 |
| I1 | R |
| I2 | Ou |
| I3 | 20 |
| I4 | 1 |
| I5 | 3 |
| I6 | N |

EMBROIDERY DATA PROCESSING SYSTEM FOR AUTOMATIC SEWING MACHINE

BACKGROUND OF THE INVENTION

The present invention relates to an embroidery data processing system for calculating stitching points for an embroidery design to be made by an automatic sewing machine.

Formation of an embroidery design on a foundation fabric with an automatic sewing machine requires information about stitch positions which indicate stitching points of the embroidery design. U.S. Pat. No. 4,388,883, for example, discloses a system for processing such stitch position information to be supplied to an automatic sewing machine. According to the disclosed processing system, an embroidery design to be formed on a fabric is represented by a combination of polygonal blocks. Stitching points of the embroidery design are calculated from such simple items of information given to the system as the positional coordinates of the vertexes of each block and the thread density of stitches to be formed in each block.

When an embroidery design is formed based on such calculated stitching points, it has clear boundary lines B 1 between adjacent blocks as shown in FIG. 19 of the accompanying drawings. However, such clear boundary lines may not be desirable in some embroidery works. For example, it is preferable for an embroidery design of a scenery not to have clear boundary lines but to have blurred or indistinct boundary lines as shown in FIG. 20. The known processing system is however unable to form such an embroidery design.

In order to make an embroidery work with indistinct boundary lines, it has heretofore been necessary to prepare information as to all stitching points, which is a very laborious and time-consuming process. Particularly, stitching points are positioned in a complex pattern across a boundary line B between adjacent blocks, and it has been highly difficult to determine each of such stitching points in advance.

If stitching points are to be differently positioned across a boundary line, i.e., if a boundary line is to be blurred differently, then information about all stitching points has to renewed. Therefore, design changes cannot quickly be carried out.

Another known processing system disclosed in U.S. Pat. No. 4,520,745 processes stitching point information about a sectorial block. According to this system, every other stitching point on a radially inner side of a sectorial block is positionally shifted into the block, thus preventing stitches from being too crowded on the radially inner side.

In the conventional embroidery processing systems, stitching points are formed in principle on opposite sides staggered across a side or boundary line, the embroidery design must be divided into as many blocks as the number of such staggered stitching point. For example, when an embroidery design having a staggering righthand side is to be formed as shown in FIG. 21, it is necessary to divide the embroidery design into a great number of blocks U1V1V2U2, U2W1W2U3, U3V3-V4U4, . . . associated with respective staggering stitching points as shown at an enlarged scale in FIG. 22.

Consequently, when such an embroider work with staggering stitching points across a side is to be formed, as many items of information about stitching points must be prepared as the number of all stitching points.

The preparation of those items of information requires a large expenditure of labor and time.

If an embroidery design is to be differently blurred or staggered across one or both sides, i.e., if stitching points are to be positioned in a different staggering pattern across one or both sides, then the embroidery design has to be newly divided. Therefore, no quick changes in embroidery designs have been possible.

SUMMARY OF THE INVENTION

It is an object of the present invention to provide an embroidery data processing system for enabling an automatic sewing machine to form an embroidery design having a staggering side with a reduced amount of information about stitching points.

Another object of the present invention is to provide an embroidery data processing system which is capable of producing information about embroidery stitches with a reduced effort and of quickly effecting design changes.

To achieve the above and other objects, there is provided according to one aspect of the present invention, an embroidery data processing system for determining stitching points defining an embroidery pattern to be stitched with a thread, wherein the embroidery pattern is divided into a plurality of blocks, each having an outer profile defined by at least three sides, and the stitching points are determined with respect to each of the plurality of blocks, comprising first memory storage means for storing side information indicating sides of each of the plurality of blocks, second memory storage means for storing thread density information indicating a thread density of the embroidery pattern in each of the plurality of blocks, third memory storage means for storing in/out displacement information indicating stitching points to be displaced inward/outward with respect to at least one preselected side of one of the plurality of blocks, and control means for calculating the displaced stitching points depending on the thread density information and the in/out displacement information with respect to the preselected side of one of the plurality of blocks, and for calculating the stitching points to be formed along the remaining sides of the plurality of blocks depending on the side information.

According to another aspect of the invention, there is provided an embroidery data processing system for determining stitching points defining an embroidery pattern to be stitched with a thread, wherein the embroidery pattern is divided into a plurality of blocks arranged in a predetermined direction in succession, each block having an outer profile defined by at least three sides, the stitching points are formed in a direction substantially parallel to the predetermined direction, and the stitching points are determined with respect to each of the plurality of blocks, comprising first memory storage means for storing side information indicating sides of each of the plurality of blocks, second memory storage means for storing thread density information indicating a thread density of the embroidery pattern in each of the plurality of blocks, third memory storage means for storing in/out displacement information indicating stitching points to be displaced inward/outward with respect to at least one preselected side of one of the plurality of blocks, and control means for calculating the displaced stitching points depending on the thread density information and the in/out displacement information with respect to the preselected side of one of the plurality of blocks, and for calculating the stitching points to be formed along the remaining sides of the plurality of blocks depending on the side information.

The above and other objects, features and advantages of the present invention will become more apparent from the following description when taken in conjunction with the accompanying drawings in which preferred embodiments of the present invention are shown by way of illustrative examples.

BRIEF DESCRIPTION OF THE DRAWINGS

FIG. 3 is a table of items of information stored for processing embroidery data with an embroidery data processing system according to a first embodiment of the present invention;

FIG. 4 is a table of items of information which are given by way of example to produce an embroidery design with the embroidery data processing system of the first embodiment;

FIG. 7 is a table of items of information which are given by way of example to produce an embroidery design with an embroidery data processing system according to a second embodiment of the present invention;

FIGS. 10A, 10B, 11A, 11B, 12A, 12B, and 13A, 13B are diagrams showing in/out patterns for stitching points and corresponding embroidery patterns;

FIG. 14 is a table of items of information given by way of example to form an embroidery design having three vertical stripes, similar to the French flag, with the embroidery data processing system of the second embodiment;

FIG. 15 is view of the embroidery design formed according to the items of information shown in FIG. 14;

FIG. 16 is an enlarged view of an encircled area of the embroidery design shown in FIG. 15;

DETAILED DESCRIPTION OF THE PREFERRED EMBODIMENTS

Figure 1:
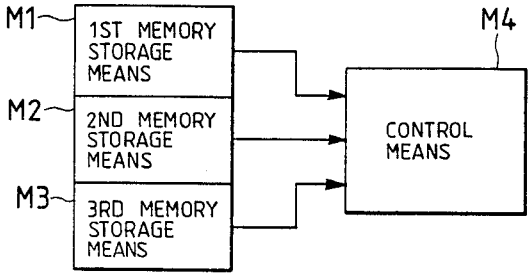
FIG. 1 is a block diagram of an embroidery data processing system according to the present invention.

FIG. 1 schematically shows in block form an embroidery data processing system according to the present invention. The embroidery data processing system for determining stitching points for stitches in a plurality of blocks which make up an embroidery design comprises first memory storage means Ml for storing side information indicating sides of each of the blocks, second memory storage means M2 for storing thread density information indicating the thread density of stitches to be formed in the each block, third memory storage means M3 for storing in/out patterns indicating how stitching points are to be displaced with respect to the sides of a selected one of the blocks, which are indicated by the side information, and control means M4 for calculating stitching points depending on the thread density information along the sides of the selected block according to the in/out patterns, and for calculating stitching points depending on the thread density information along the sides of another block than the selected block, which are indicated by the side information.

Figure 2:
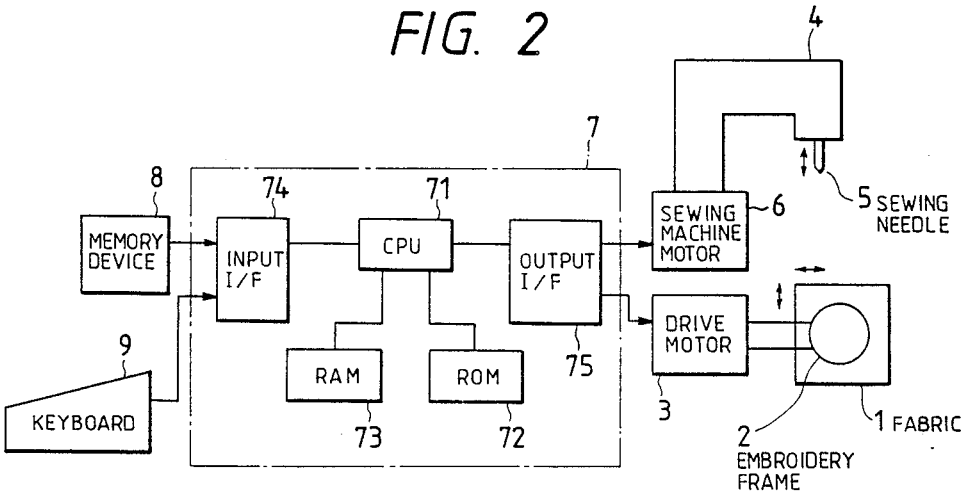
FIG. 2 is a detailed block diagram of the embroidery data processing system.

The embroidery data processing system is shown in greater detail in FIG. 2.

The embroidery data processing system controls an automatic sewing machine having an embroidery frame 2 with a fabric 1 fixed thereto, a drive motor 3 for moving the embroidery frame 2 in X and Y directions, a sewing needle 5 vertically movably supported by a sewing machine arm 4, and a sewing machine motor 6 for vertically moving the sewing needle 5.

The embroidery data processing system includes an electronic controller 7 for controlling the motors 3, 6, a memory device 8 for supplying information about embroidery designs to the electronic controller 7, and a keyboard 9 for applying various instructions to the electronic controller 7.

The electronic controller 7 comprises a logic arithmetic circuit including a CPU 71, a ROM 72, a RAM 73, an input interface 74 for receiving design data from the memory device 8, and an output interface 75 for supplying control signals to thmotors 3, 6. Various instructions from the keyboard 9 are sent through the input interface 74 to the CPU 71.

According to a first embodiment of the present invention, as shown in FIG. 3, the memory device 8 has a side information storage area **8*a*, a thread density information storage area 8*b*, and an in/out pattern storage area 8*c***.

FIG. 3 shows, by way of example, items of information stored in the storage areas **8*a*, 8*b*, 8*c* to enable the automatic sewing machine to embroider parallelogrammatic or triangular blocks. The side information storage area 8*a* stores, as information to specify the sides of a block, the vector-indicated positions SD1 through SD4 of the vertexes of a block which are successively arranged from a stitch starting point in a clockwise or counterclockwise order depending on the direction in which to form the second stitching point. More specifically, the items of information stored in the side information storage area 8*a* indicate that an even-numbered stitching point is formed near a side which is specified by the second and third vertexes SD2, SD3, and an odd-numbered stitching point is formed near a side which is specified by the fourth and first vertexes SD4, SD1**. If a triangular block is to be embroidered, the same item of information for one vertex is stored.as SD1, SD2. Therefore, the items of information stored for forming a triangular block also indicate that the side indicated by the vertexes SD1, SD4 is a side near an odd-numbered stitching point whereas the side indicated by the vertexes SD2, SD3 is a side near an even-numbered stitching point.

The thread density information storage area 8b stores a thread density d representing the number of stitches to be formed per unit length along a central line of a block which extends in the direction in which the stitches are successively formed.

The in/out pattern storage area 8c stores an in/out order Il representing which stitching point, as counted from a starting stitching point, is to be displaced in or out with respect to a side of a block, and an in/out ratio I2 indicating the amount by which the specified stitching point is to be displaced in or out, i.e., the ratio of the length of a stitch formed up to the specified stitching point to the length of a stitch which would otherwise be formed if the specified stitching point were not displaced in or out. When the in/out ratio I2 is larger than "1", the specified stitching point is displaced out of the block across the side thereof, and when the in/out ratio I2 is smaller than "1", the specified stitching point is displaced into the block across the side thereof.

Figure 5:
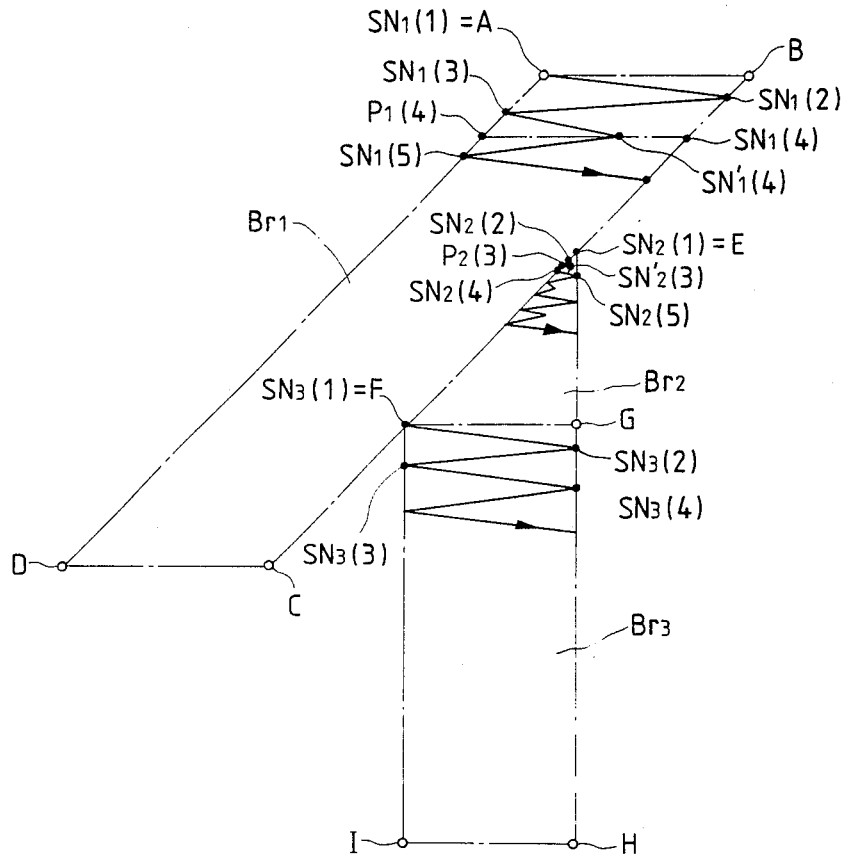
FIG. 5 is view of the embroidery design produced with the items of information shown in FIG. 4.

A process of calculating stitching points, effected by the electronic controller 7, will be described below, by way of example, with reference to FIGS. 4 and 5.

Items of information about stitching points will first be described. A Japanese Katakana letter "τ" is divided into three blocks Br1, Br2, and Br3 as shown in FIG. 5. The first block Br1 is in the shape of a parallelogram and starts being embroidered from an upper lefthand vertex A. The first block Br1 is embroidered by forming stitching points on and near lefthand and righthand sides alternately, with every fourth stitching point being displaced into the block Br1, thus blurring the lefthand side of the block. The items of information needed to form the first block Br1 include four vertex positions A, B, C, D arranged successively clockwise from the starting vertex position A, stored in the side information storage area 8a, a thread density dl stored in the thread density information storage area 8b, and an in/out order I1=4 and an in/out ratio I2=0.7 stored in the in/out pattern storage area 8c.

The second block Br2 is in the shape of a triangle and starts being embroidered from an upper vertex E. The second block Br2 is embroidered by forming stitching points on and near lefthand and righthand sides alternately. The items of information needed to from the second block Br2 include four vertex positions E, E, F, G (actually three) arranged successively counterclockwise from the starting vertex position E, stored in the side information storage area 8a, and a thread density d2 stored in the thread density information storage area 8b. No in/out pattern information is stored in the in/out pattern storage area 8c. However, the righthand side is actually blurred as described later on.

The third block Br3 is in the shape of a parallelogram and starts being embroidered from an upper lefthand vertex F. The third block Br3 is embroidered by forming stitching points on and near lefthand and righthand sides alternately. The items of information needed to form the third block Br3 include four vertex positions F, G, H, I arranged successively clockwise from the starting vertex position F, stored in the side information storage area 8a, and a thread density d3 stored in the thread density information storage area 8b. No in/out pattern information is stored in the in/out pattern storage area 8c since no side of the third block Br3 is blurred.

Figure 6:
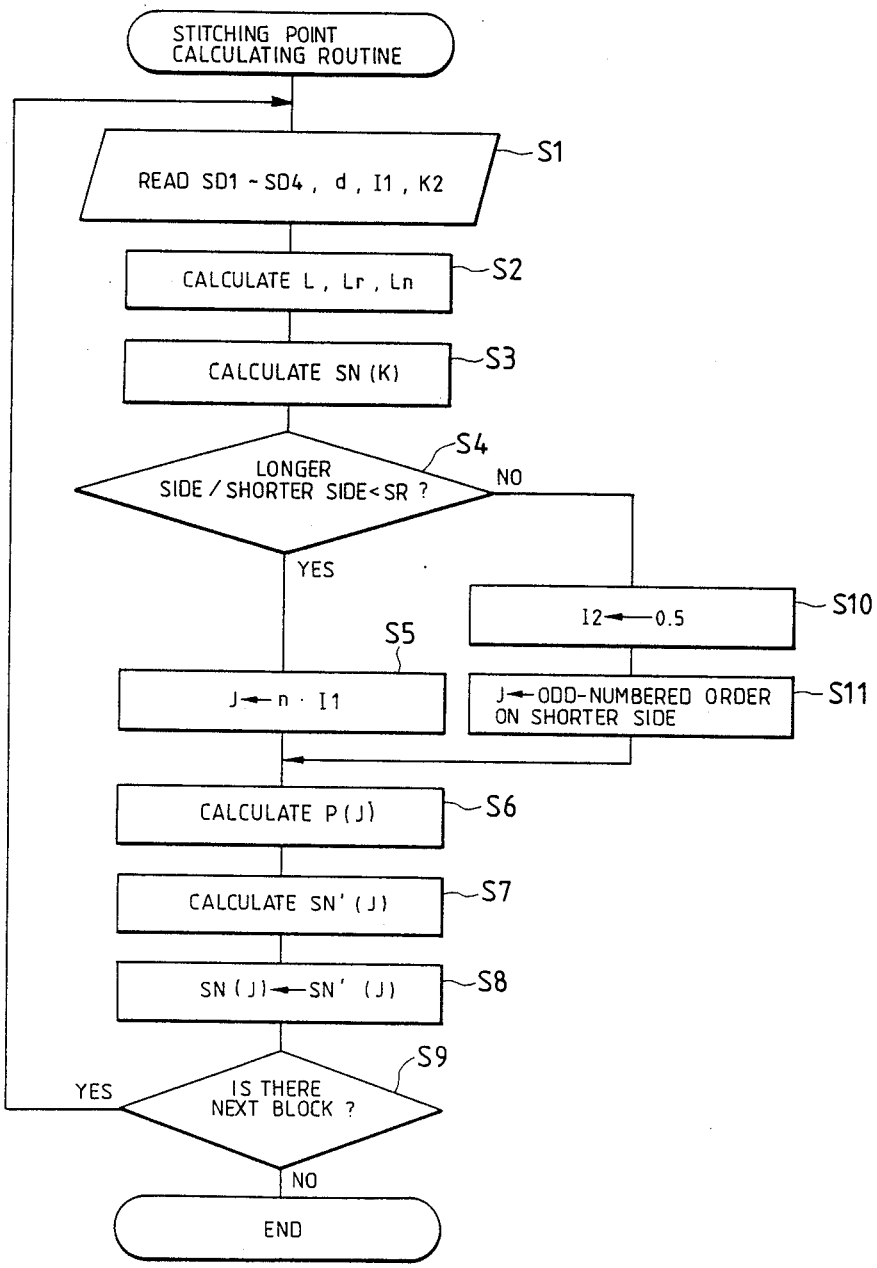
FIG. 6 is a flowchart of an operation sequence of the embroidery data processing system of the first embodiment.

FIG. 6 shows an operation sequence executed by the electronic controller 7 to effect the stitching point calculating process.

First, the items of information SD1 through SD4, dl, I1, I2 for the first block Br1 are read from the memory 8 in a step Sl. The length Lλl of the lefthand side AD and the length Lrl of the righthand side BC of the first block Br1 are calculated based on the vertex positions A, B, C, D thus read, and the number of stitches Ln1 to be formed in the wrist block Br1 is calculated based on the thread density dl in a step S2. Then, stitching point candidate positions SNl(1), SNl(2), SNl(3), . . . for embroidering the block Br1 with no blurred side are calculated based on the gradient of the lefthand and righthand sides AD, BC and the number of stitches Lnl in a step S3. Thereafter, a process of blurring a side of the first block Br1 is initiated.

In the side blurring process, a step S4 determines whether the ratio of a longer side to a shorter side of the block is smaller than a preset longer/shorter-side ratio SR stored in the ROM 73. The step S4 is carried out to automatically prevent stitches from being too crowded. Specifically, when a triangular block whose lefthand and righthand sides have different lengths is to be embroidered, if the same number of stitches were to be formed on each of the side, then the stitches would become too crowded on the shorter side. The step S4 serves to solve such a problem.

Since the lefthand and righthand sides AD, BC of the first block Br1 are equal in length to each other, control goes from the step S4 to a step S5 in which a blurring order J indicating those stitching points which are to be displaced is set to multiples of the in/out order I1=4, i.e., 4, 8, 12, . . . . If no information is stored in the in/out order I1, then the blurring order J is set to zero.

Based on the blurring order J, a midpoint Pl(j) between the (J−1)th stitching point candidate SD1(J−1) and the (J+1)th stitching point candidate SD1(J+1) is calculated in a step S6. Then, a point SNl'(J) at which the line segment Pl(J) SD1(J) is internally divided with the in/out ratio I2=0.7 is calculated in a step S7. The calculated internally dividing point SNl'(J) is regarded as the Jth stitching point candidate SNl(J) in a step S8. After the stitching point candidates SNl(K) have thus been calculated for the first block Br1, a step S9 determines whether there is a next block following the first block Br1 or not.

Since the embroidery design includes the second block Br2 in this example, control returns from the step S9 to the step Sl to calculate stitching points again.

The second block Br2 is of a triangular shape, and hence the righthand side EG is shorter than the lefthand side EF. Therefore, Lλ2/Lr2 ≧ SR in the step S4, and the in/out ratio I2 is set to 0.5 in a step S10. The in/out ratio I2 is set to 0.5 in order to prevent stitches from becoming too crowded on the shorter side EG. The value 0.5 is stored in the ROM 72 in advance, but may be entered through the keyboard 9 when the calculating process is started.

Then, the blurring order J is set to even numbers on the shorter side EG, i.e., values 3, 5, . . . in this example in a step SI1. With the blurring order J being thus set, every other stitching point near the shorter side EG is displaced into the block Br2, thus preventing stitching points from becoming too crowded on the side EG.

Thereafter, as with the calculating process for the first block Br1, a midpoint P2(J) is calculated in the step S6, an internally dividing point SN2'(J) is calculated in the step S7, and stitching points SN2(K) are determined in the steps S6 through S8.

Then, stitching points for the third block Br3 are calculated in a similar manner. Since the blurring order J is set to zero as described above, however, stitching point candidates SN3(K) calculated in the step S3 are used as final stitching points.

Based on the stitching point candidates SN(K) thus calculated, the electronic controller 7 controls the motors 3,6 to operate the automatic sewing machine. As a result, the automatic sewing machine forms the embroidery design "$\tau$" as shown in FIG. 5 in which the right-hand side BC of the first parallelogrammatic block Br1 is intentionally blurred, the shorter side EG of the second triangular block Br2 is forcibly blurred, and the third parallelogrammatic block Br3 is stitched equally on its lefthand and righthand sides.

According to the first embodiment shown in FIGS. 3 through 6, an embroidery design in which stitching points are displaced in and out with respect to desired block sides can be formed based on only information about the sides of the blocks, information about the thread density, and information about the selectively specified in/out patterns even if information as to all stitching points is not entered. Stitching point information for such an complex embroidery design can therefore be prepared with ease and less efforts.

A side with respect to which stitching points are to be displaced in and out can be determined by the in/out order I1. If "2" is used as the in/out order I1, then every second stitching point, i.e., all stitching points on one side can be displaced from that side. If an odd number, e.g. "3" is used as the in/out order I1, then every third stitching point, i.e., every other stitching point on each side can be displaced from that side. The amount or distance by which a stitching point is to be displaced can freely be specified by the in/out ratio I2. Accordingly, stitching points for various embroidery designs can be calculated based on combinations of the in/out order I1 and the in/out ratio I2.

Since the items of information I1, I2 are quite simple, any of variously blurred embroidery designs can easily be formed by selecting the items of information I1, I2 in various combinations. A blurred embroidery design can further be blurred differently by varying the thread density d. Such an advantage accrues from the fact that an embroidery design is represented by a combination of independent, simple, and particular items of information SDn, d, I1, and I2.

Information about any of various different blurred embroidery designs for one block can be prepared by varying at least one of the items of information d, I1 and I2. Consequently, an embroidery design can quickly be modified by a minimum work to vary only information as to a necessary design element.

Stitches are prevented from becoming too crowded on one side by automatically comparing the ratio between the lengths Lλ, Lr of the sides on which stitching points are to be formed with the preset longer/shorter-side ratio SR. Therefore, the operator is not required to pay attention to crowded stitches when information about stitches is prepared, The keyboard 9 may be used to indicate whether a block side is to be forcibly blurred based on the longer/shorter-side ratio SR at the time of starting the calculating process. Therefore, if an embroidery design with crowded stitches is desired, the forced blurring process can be canceled by the keyboard 9.

FIG. 7 shows items of information which are stored in an embroidery data processing system according to a second embodiment of the present invention. The embroidery data processing system of the second embodiment is essentially the same as the embroidery data processing system of the first embodiment, except that the memory device thereof stores items of information required to form embroidery designs as shown in FIG. 7. More specifically, as shown in FIG. 1, the embroidery data processing system for determining stitching points for stitches in a plurality of blocks which make up an embroidery design comprises first memory storage means MI for storing side information indicating vertex positions along sides of each of the blocks second memory storage means M2 for storing thread density information indicating the thread density of stitches to be formed in the each block, third memory storage means M3 for storing in/out patterns indicating how stitching points are to be displaced with respect to the sides of the each block which are indicated by the side information, and control means M4 for calculating stitching points depending on the thread density information along the side of the each block according to the in/out patterns.

In FIGS. 7, the memory device includes a side information storage area 8*a*, a thread density information storage area 8*b*, and an in/out pattern storage area 8*d*. It is assumed here that each block of an embroidery design to be formed is of a parallelogrammatic shape. However, a block may be triangular in shape. The side information storage area 8*a* stores, as information to specify the sides of a block, the vector-indicated positions A through D of the vertexes of a block which are successively arranged in a certain sequence.

The thread density information storage area 8*b* stores a thread density d representing the number of stitches to be formed per unit length along a central line of a block which extends in the direction in which the stitches are successively formed.

The in/out pattern storage area 8*c* stores an in/out pattern which includes displacing side information I1, displacing direction information I2, a maximum displacing ratio I3, the number of non-displaced stitches I4, the number of displaced stitches I5 and a displacing type I6.

The displacing side information Il is information for indicating a side with respect to which stitching points are to be displaced. If stitching points are to be displaced in or out with respect to a lefthand side, then the displacing side information Il is stored as Il=L. If stitching points are to displaced in or out with respect to a righthand side, then the displacing side information Il is stored as Il=R. If stitching points are to be displaced in or out with respect to both lefthand and righthand sides, the displacing side information Il is stored as Il=LR. The displacing direction information I2 is information which represents the direction in which a stitching point is to be displaced with respect to a side. If a stitching point is to be displaced out of a block, then the displacing direction information I2 is stored as I2=Ou, and if a stitching point is to be displaced into a block, then the displacing direction information I2 is stored as I2=In. The maximum displacing ratio I3 is the ratio of the maximum amount by which a stitching point is to be displaced to the length of a stitch if the stitch were not displaced, the ratio being indicated by a percentage. The number of nondisplaced stitches I4, the number of displaced stitches 15, and the displacing type I6 indicate a basic unit of an in/out pattern at the time of calculating stitching points. For example, the items of information I4=3 and I5=2 indicate that three successive stitching points from the first stitch are positioned on a side indicated by the displacing side information Il, and next two successive stitching points are displaced from that side. The displacing type I6 cooperates with the maximum displacing ratio I3 in indicating displacing ratios for individual stitching points and selecting one of certain displacing types stored in the memory device. If a normal type in which the displacing ratio is equal to the maximum displacing ratio is to be specified, then the displacing type I6 is I6=N. If the displacing ratio is to be varied in a sawtooth pattern, the displacing type I6 is I6=W1. If the displacing ratio is to be random based on a table of random numbers, then the displacing type I6 is I6=Ra.

A process of calculating stitching points, effected by the electronic controller 7 associated with the memory device shown in FIG. 7, will be described below, by way of example, with reference to FIGS. 8 and 9.

Figure 8:
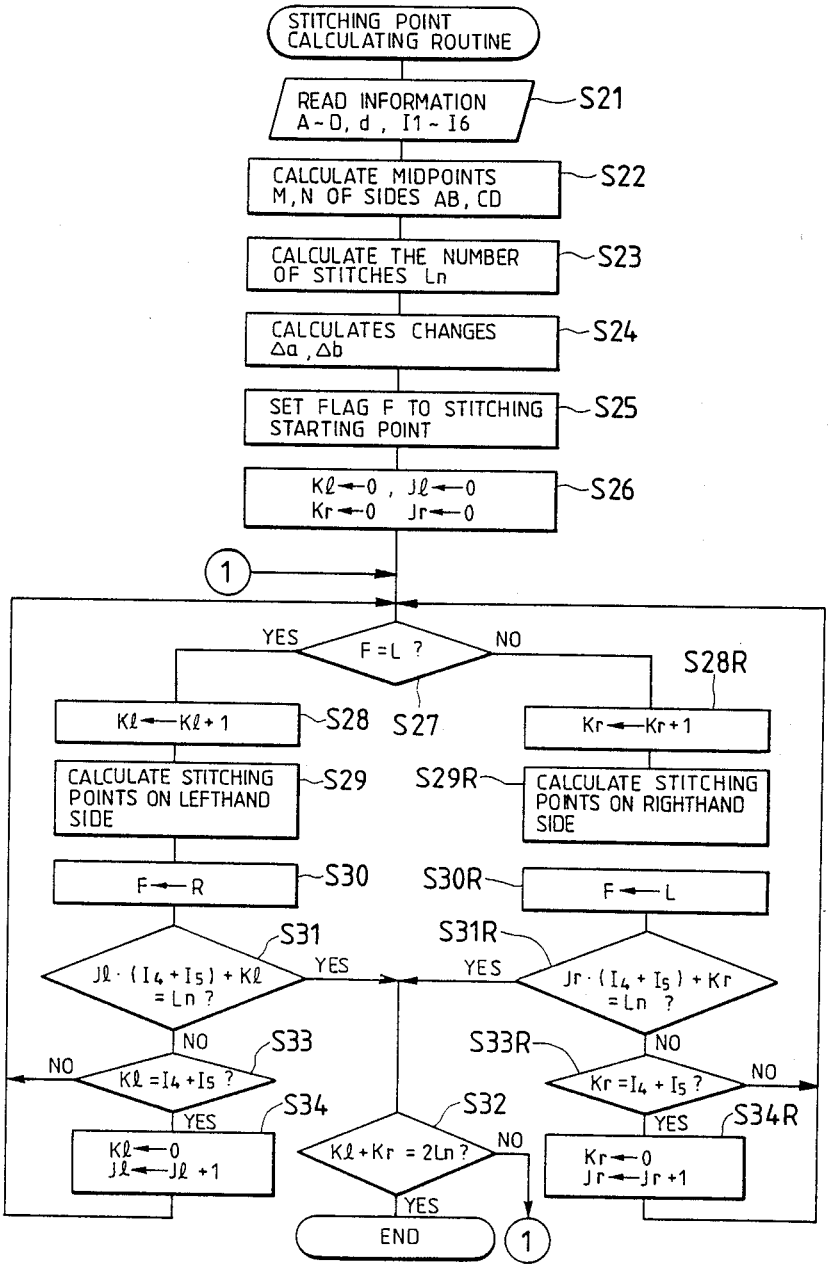
FIG. 8 is a flowchart of an operation sequence of the embroidery data processing system of the second embodiment.

As shown in FIG. 8, the items of information A through D, d, Il through I6 are read from the memory device 8 in a step S21. Then, midpoints M, N of upper and lower sides AB, CD of a block are calculated based on positional coordinates A through D in a step S22, and the number stitches Ln to be formed in the block is calculated from the length of a line extending between the midpoints M, N and the thread density d in a step S23. Changes Δa, Δb in the positional vectors of stitching points calculated along the lefthand and righthand sides AC, CD if no stitching points are to be displaced are calculated from the gradients of the sides AC, CD in a step S214. Then, a flag F indicating a side with respect to which stitching points are to be calculated is set to a side including a stitching starting point, i.e., F is set to F=L if the stitching starting point is the upper lefthand vertex A, in a step S25, and counters Kλ, Jλ, Kr, Jr are cleared in a step S26. The counts of the counters Kλ, Kr indicate the calculated number of stitches on the lefthand and righthand sides, and the counts of the counters Jλ, Jr indicate how many times an in/out pattern of a basic unit is calculated.

Subsequent calculating processes for the lefthand and righthand sides of the block are substantially the same as each other. Therefore, only the steps of the calculating process for the lefthand side of the block will be described below. The corresponding steps of the calculating process for the righthand side are indicated by identical reference characters with a suffix R.

If the flag F indicates the calculating process for the lefthand side in a step S27, then the counter Kλ is incremented by 1 in a step S28, and the calculating routine for a stitching point on the lefthand side is effected in a step S29. After the stitching points on the lefthand side are calculated, the flag F is changed to R in a step S30, and steps S31, S32 determine whether all calculations are finished or not. If all calculations for the lefthand side are finished, i.e., if Jλ (I4+I5)+Kλ=Ln in the step S31, and if all calculations for the righthand side are finished, i.e., if Kλ+Kr=2Ln in the step S32, then the calculating process for the block is brought to an end.

If the calculations for the lefthand side are not yet finished in the step S31, then a step S33 determines whether one in/out pattern has been calculated or not, i.e., whether Kλ=I4+I5 or not. If one in/out pattern has not yet been the counter Kλ is cleared and the counter Jλ is incremented by 1 in a step S34. Control then goes back to the step S27.

The same steps S28R are then carried out to calculate a stitching point for the righthand side. Stitching points for the lefthand and righthand sides are then alternately calculated repeatedly until the condition Kλ+Kr=2Ln is reached in the step S32.

The calculating routine for a stitching point on the lefthand side in the step S29 will be described with reference to FIG. 9. A stitching point Pλo which would be defined if it were not displaced is calculated in a step S91 as the sum of positional vectors of the vertex A and the change Δa on the lefthand side, as follows:

$$P\lambda o = A + \Delta a.\}(K\lambda - 1) + J\lambda \cdot (I4 + I5)\}$$

Then, a step S92 determines whether it is instructed to displace a stitching point from the lefthand side, i.e., whether Il=L or Il=LR. If yes, then a step S93 determines whether the stitching point that is about to be calculated at present is a stitching point to be displaced, i.e., whether I4≦KλI4+I5 or not. If the stitching point is to be displaced, then the displacing ratio Rpo is calculated based on the maximum displacing ratio I3, the number of displaced stitches I5, and the displacing type I6 in a step S94. For example, if I33=20, I53=5, I63=W1 as shown in FIG. 12A and Kλ=3, then the displacing ratio Rpo=20. $(\frac{2}{3})\approx 13.3$ because of the proportional relationship. If I34=20, I54=999, and I64=Ra as shown in FIG. 12B, then the displacing ratio Rpo is calculated based on the table of random numbers stored in the ROM 72. Then, a final stitching point is calculated based on the calculated displacing ratio Rpo according to the equation:

$$P\lambda = P\lambda o - Rpo \cdot [P\lambda o - B - \Delta b \cdot \{(K\lambda - 1) + J\lambda \cdot (I4 + I5)\}]$$

in a step S95. If the stitching point is not to be displaced in the step S92 or S93, then the final stitching point is determined in a step S96 as the stitching point Pλo which has been calculated in the step S91.

Based on the stitching points Pλ thus calculated, the electronic controller 7 controls the motors 3, 6 to enable the sewing machine to produce an embroidery design with a blurred side or boundary line.

FIGS. 10A, 10B, 11A, 11B, 12A, 12B, and 13A, 13B show in/out patterns or items of displacing information Il through I6 for stitching points and rectangular embroidery blocks produced according to the in/out patterns.

In FIGS. 10A and 10B, every other stitching point (I41=1, I51=1) is displaced out of a block (I21=Ou) from the lefthand side (Ill=L) over 20% of the stitch length (I31=20) in a normal pattern (I61=N), thus forming an embroidery pattern.

FIGS. 11A and 11B show an embroidery pattern in which the last two stitching points out of each group of five stitching points (I42=3, I52=2) are displaced into a block (I22=In) from the righthand side (II2=R) over 20% of the stitch length (I31=20) in a normal pattern (I61=N).

FIGS. 12A and 12B show an embroidery pattern in which the last five stitching points out of each group of six stitching points (I43=1, I53=5) are displaced out of a block (I23=Ou) from the lefthand side (I13=L) over a maximum of 20% of the stitch length (I33 TM 20) in a saw-tooth pattern (I61=W1).

In FIGS. 13A and 13B, all stitching points except the first one (I44=1, I54=999) is displaced out of a block (I24=Ou) from the lefthand and righthand sides (I14=LR) over a maximum of 20% of the stitch length (I34=20) in a random pattern (I64=Ra), thus forming an embroidery pattern.

As shown in FIGS. 14 through 16, it is possible for the embroidery data processing system of the second embodiment to control the automatic sewing machine to produce an embroidery design composed of three adjacent blocks with blurred boundary lines (FIGS. 15 and 16) based on a total 33 items of information (FIG. 14).

Figures 17, 18:
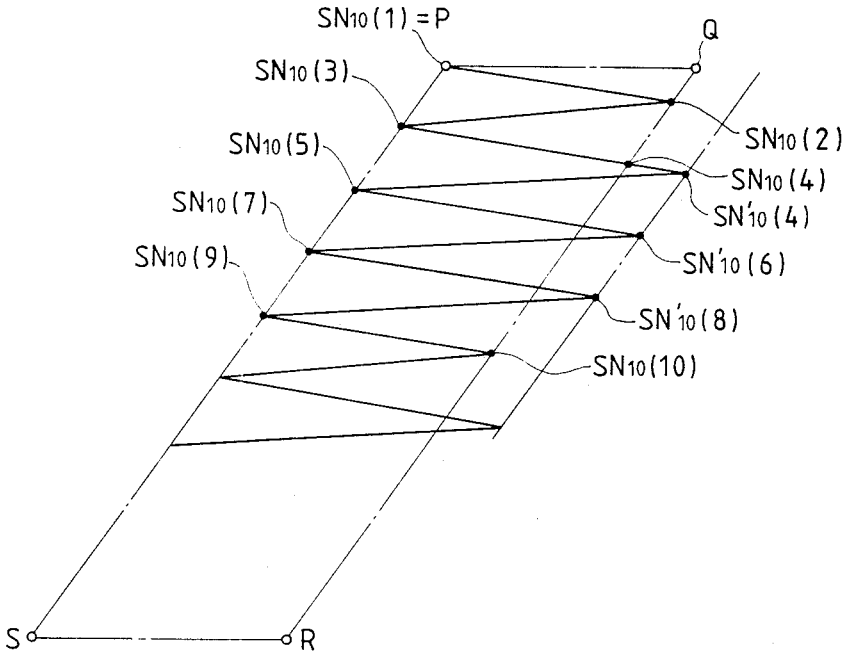
FIG. 17 is a table of items of information given by way of example to form an embroidery design with the embroidery data processing system of the second embodiment.
FIG. 18 is a view of the embroidery design produced according to the items of information shown in FIG. 17.
Figure 19:
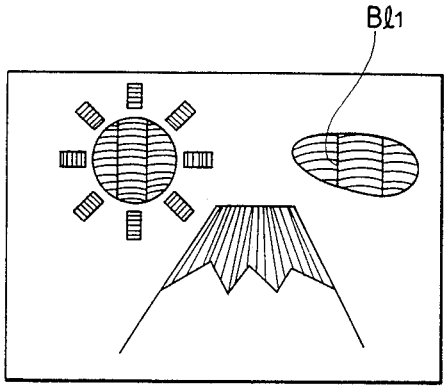
FIG. 19 is a view of an embroidery design produced by a conventional embroidery data processing system.
Figure 21:
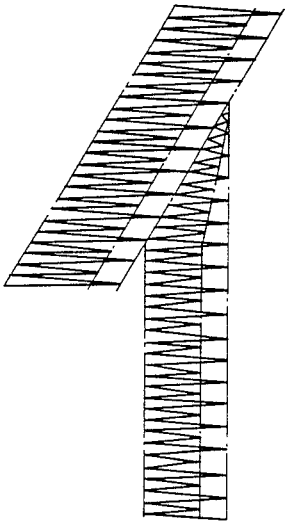
FIG. 21 is a view of an embroidery design with a blurred righthand side, produced by a conventional embroidery data processing system.
Figure 20:
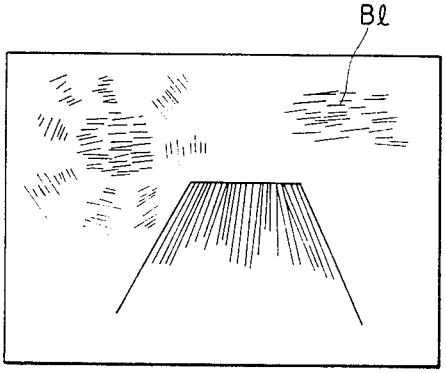
FIG. 20 is a view of an embroidery design with blurred boundary lines.
Figure 22:
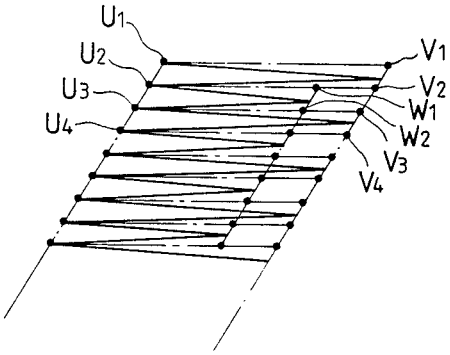
FIG. 22 is an enlarged view of an upper portion of the embroidery design illustrated in FIG. 21.

FIG. 17 shows another group of items of information supplied to the embroidery data processing system of the second embodiment to form an embroidery design of a parallelogrammatic shape shown in FIG. 18.

Figure 9:
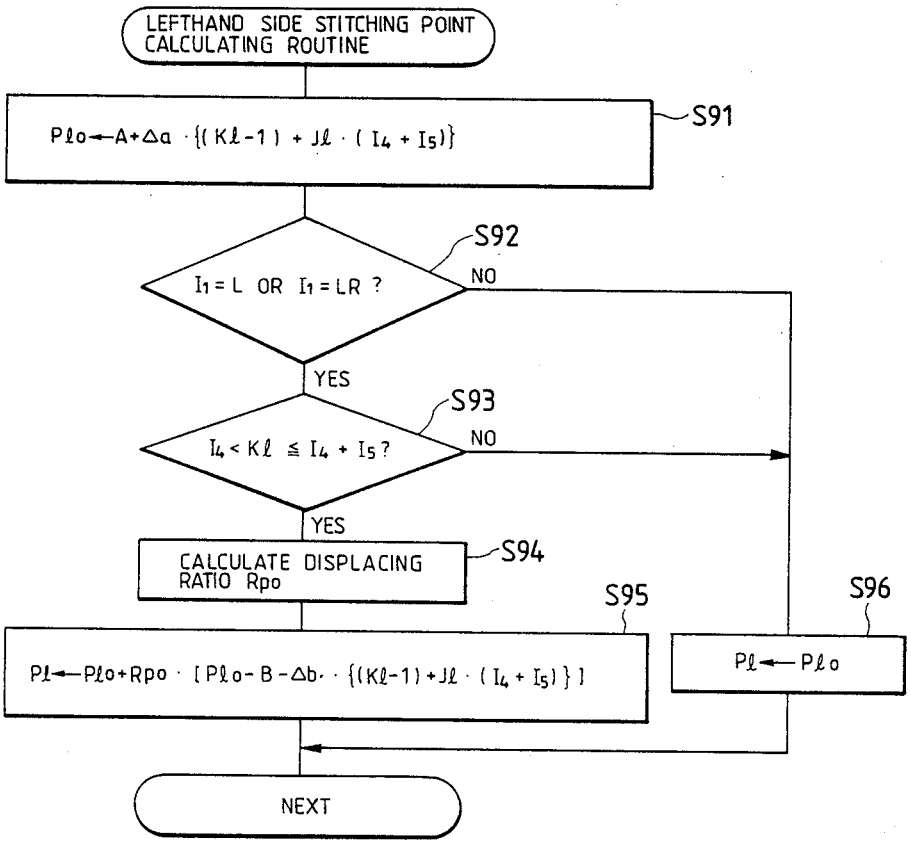
FIG. 9 is flowchart of a lefthand stitching point calculating routine in the operation sequence shown in FIG. 8.

Each of the embroidery designs of FIGS. 15 and 18 can be produced substantially according to the operation sequence shown in FIGS. 8 and 9.

With the embroidery data processing system according to the second embodiment, an embroidery design with blurred boundary lines in which stitching points are displaced in and out with respect to desired block sides can be formed based on only information about the sides of the blocks into which the embroidery design is divided, information about the thread density, and information about the selectively specified in/out patterns, even if information as to all stitching points is not entered. Stitching point information for such an complex embroidery design can therefore be prepared with ease and less efforts.

Even if the vertex positions A through D, giving side information, and the thread density d are the same, the items of information Il through I6 relative to in/out patterns may be combined in any of various patterns to produce any of various embroidery designs of differently blurred boundary lines. Different embroidery works may also be formed by varying only the thread density d. Therefore, an embroidery design is represented by a combination of independent, simple, and particular items of information A through D, d, and Il through I6.

Information about any of various different blurred embroidery designs for one block can be prepared by varying at least one of the items of information d and Il through I6. Consequently, an embroidery design can quickly be modified by a minimum work to vary only information as to a necessary design element.

Since the displacing ratio is calculated from the maximum displacing ratio I3, the number of displaced stitches I5, and the displacing type I6, any of various other embroidery designs than the illustrated designs, such as an embroidery design having stitching points displaced along a sine wave, can also be formed with utmost ease.

The embroidery data processing system according to the present invention can be used to produce any of various embroidery designs which may be divided into blocks having curved sides using data on curvature, for example, as well as parallelogrammatic and triangular blocks as illustrated above.

Although certain preferred embodiments have been shown and described, it should be understood that many changes and modifications may be made therein without departing from the scope of the appended claims.

What is claimed is:

1. An embroidery data processing system for determining stitching points defining an embroidery pattern to be stitched with a thread, wherein the embroidery pattern is divided into a plurality of blocks, each having an outer profile defined by at least three sides, and the stitching points are determined with respect to each of the plurality of blocks, comprising:

first memory storage means for storing side information indicating vertex positions along sides of each of the plurality of blocks;

second memory storage means for storing thread density information indicating a thread density of the embroidery pattern in each of the plurality of blocks;

third memory storage means for storing in/out displacement information indicating stitching points to be displaced inward or outward with respect to a preselected side of one of the plurality of blocks; and control means for calculating the displaced stitching points depending on the thread density information and the in/out displacement information with respect to the preselected side of one of the plurality of blocks, and for calculating the stitching points to be formed along the remaining sides of the plurality of blocks depending on the side information.

2. An embroidery data processing system according to claim 1, wherein said in/out displacement information represents which stitching point is to be displaced with respect to the preselected side, and an amount by which the stitching point is to be displaced from the preselected side.

3. An embroidery data processing system according to claim 2, wherein said in/out displacement information further represents the preselected side.

4. An embroidery data processing system according to claim 3, wherein said in/out displacement information further represents the direction in which the stitching point is displaced from the preselected side.

5. An embroidery data processing system according to claim 4, wherein said in/out displacement information further represents a ratio of a maximum amount by which a stitching point is to be displaced to a corresponding length of a stitch to be formed on the preselected side.

6. An embroidery data processing system according to claim 5, wherein said in/out displacement information further represents a displacement type in which the stitching points are to be displaced with respect to the preselected side.

7. An embroidery data processing system according to claim 6, wherein the displacement type indicates that the stitching points are displaced in a sawtooth pattern with respect to the preselected side.

8. An embroidery data processing system according to claim 6, wherein the displacement type indicates that the stitching points are displaced at random with respect to the preselected side.

9. An embroidery data processing system according to claim 1, wherein the stitching points are selectively displaced from a side when the side information indicates that a ratio of a length of the side to a length of a confronting side is less than a predetermined value.

10. An embroidery data processing system for determining stitching points defining an embroidery pattern to be stitched with a thread, wherein the embroidery pattern is divided into a plurality of blocks arranged in a predetermined direction in succession, each block having an outer profile defined by at least three sides, the stitching points are formed in a direction substantially parallel to the predetermined direction, and the stitching points are determined with respect to each of the plurality of blocks, comprising:

first memory storage means for storing side information indicating vertex positions along sides of each of the plurality of blocks;

second memory storage means for storing thread density information indicating a thread density of the embroidery pattern in each of the plurality of blocks;

third memory storage means for storing in/out displacement information indicating stitching points to be displaced inward or outward with respect to a preselected side of one of the plurality of blocks; and control means for calculating the displaced stitching points depending on the thread density information and the in/out displacement information with respect to the preselected side of one of the plurality of blocks, and for calculating the stitching points to be formed along the remaining sides of the plurality of blocks depending on the side information.

11. An embroidery data processing system according to claim 10, wherein said in/out displacement information represents which stitching point is to be displaced with respect to the preselected side, and an amount by which the stitching point is to be displaced from the preselected side.

12. An embroidery data processing system according to claim Il, wherein said in/out displacement information further represents the preselected side.

13. An embroidery data processing system according to claim 12, wherein said in/out displacement information further represents the direction in which the stitching point is displaced from the preselected side.

14. An embroidery data processing system according to claim 13, wherein said in/out displacement information further represents a ratio of a maximum amount by which a stitching point is to be displaced to a corresponding length of a stitch to be formed on the preselected side.

15. An embroidery data processing system according to claim 14, wherein said in/out displacement information further represents a displacement type in which the stitching points are to be displaced with respect to the preselected side.

16. An embroidery data processing system according to claim 15, wherein the displacement type indicates that the stitching points are displaced in a sawtooth pattern with respect to the preselected side.

17. An embroidery data processing system according to claim 15, wherein the displacement type indicates that the stitching points are displaced at random with respect to the preselected side.

18. An embroidery data processing system according to claim 10, wherein the stitching points are selectively displaced from a side when the side information indicates that a ratio of a length of the side to a length of a confronting side is less than a predetermined value.

* * * * *